US007012380B2

(12) United States Patent
Price et al.

(10) Patent No.: US 7,012,380 B2
(45) Date of Patent: Mar. 14, 2006

(54) INFORMATION HANDLING SYSTEM WITH DUAL MODE INVERTER

(75) Inventors: Erin L. Price, Pflugerville, TX (US); Brent A. McDonald, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 37 days.

(21) Appl. No.: 10/875,354

(22) Filed: Jun. 24, 2004

(65) Prior Publication Data

US 2005/0285546 A1 Dec. 29, 2005

(51) Int. Cl.
*H05B 37/02* (2006.01)

(52) U.S. Cl. ..... 315/209 R; 363/131

(58) Field of Classification Search ..... 315/209 R, 315/224, 225, 226; 363/123, 131; H05B 37/02
See application file for complete search history.

(56) References Cited

U.S. PATENT DOCUMENTS

| | | | | |
|---|---|---|---|---|
| 4,060,751 | A * | 11/1977 | Anderson | 315/209 R |
| 5,495,405 | A | 2/1996 | Fujimura et al. | 363/133 |
| 5,555,494 | A | 9/1996 | Morris | 363/17 |
| 5,619,402 | A | 4/1997 | Liu | 363/20 |
| 5,742,497 | A * | 4/1998 | Hashimoto et al. | 363/133 |
| 5,767,630 | A | 6/1998 | Williams | 315/282 |
| 5,875,103 | A * | 2/1999 | Bhagwat et al. | 363/17 |
| 5,959,412 | A | 9/1999 | Ushijima | 315/276 |
| 5,973,437 | A | 10/1999 | Gradzki et al. | 310/307 |
| 6,130,509 | A | 10/2000 | Kates et al. | 315/224 |
| 6,201,356 | B1 | 3/2001 | Ushijima et al. | 315/282 |
| 6,317,347 | B1 | 11/2001 | Weng | 363/134 |
| 6,469,454 | B1 | 10/2002 | Mader et al. | 315/291 |
| 6,534,967 | B1 * | 3/2003 | Weggel | 324/127 |
| 6,630,797 | B1 | 10/2003 | Qian et al. | 315/224 |
| 6,633,138 | B1 | 10/2003 | Shannon et al. | 315/224 |
| 6,683,422 | B1 | 1/2004 | Moyer | 315/307 |
| 6,693,396 | B1 | 2/2004 | Hsu | 315/291 |
| 6,831,442 | B1 * | 12/2004 | Hsu et al. | 318/803 |
| 2004/0056607 | A1 | 3/2004 | Henry | 315/219 |
| 2004/0066149 | A1 | 4/2004 | Gray | 315/244 |

OTHER PUBLICATIONS

"The Electric Wave", http://digilander.libero.it/bubblegate/ecircuit3.html?, 2004.
"Maxim Integrated Products Says . . . MAX8709: CCFL Backlight Controller With SMBus Interface", powerZone Products for the week of Mar. 15, 2004, Pataphysics Unlimited, dba analogZone.
"BL1350 AC Power Source Specification", Behlman Electronic, Inc., 2002.
"CD4069UBC Inverter Circuits", Fairchild Semiconductor Corporation, 2002.
"NC7WZ04 TinyLogic UHS Dual Inverter", Fairchild Semiconductor Corporation, 2003.
Gulko, et al., "Current-Sourcing Push-Pull Parallel-Resonance Inverter (CS-PPRI): Theory and Application as a Fluorescent Lamp Driver", IEEE Transactions on Industrial Electronics, (1994), vol. 41, Issue 3, pp. 285-291.
"High-Efficiency CCFL Backlight Controller with SMBus Interface", Maxim Integrated Products, 2004.

(Continued)

*Primary Examiner*—Thuy Vinh Tran
(74) *Attorney, Agent, or Firm*—Haynes and Boone, LLP

(57) ABSTRACT

An information handling system (IHS) is provided which includes an inverter circuit capable of operating over an extended DC input voltage range without substantial degradation in efficiency. A DC input voltage is converted to an AC input voltage. A first turns ratio of an AC transformer is applied to the AC input voltage if the DC input voltage is within a first voltage range. A second turns ratio of an AC transformer is applied to the AC input voltage if the DC voltage is within a second voltage range.

26 Claims, 3 Drawing Sheets

OTHER PUBLICATIONS

Dual Output DC to DC Converter (12VDC to +135VDC, -35VDC), PowerStream Technology, 2003.

Travis, Bill, "Little ICs Generate Big Voltages", EDN, Jun. 22, 2000, pp. 73-82, Reed Business Information.

* cited by examiner

INFORMATION HANDLING SYSTEM WITH DUAL MODE INVERTER

BACKGROUND

The disclosures herein relate generally to information handling systems (IHSs) and more particularly to supplying power to IHSs.

As the value and use of information continue to increase, individuals and businesses seek additional ways to process and store information. One option available to users is information handling systems. An information handling system (IHS) generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Today's portable IHSs typically employ inverters to convert relatively low voltage DC to high voltage AC. This high voltage AC is needed to supply power to the backlights of the IHS's display. As technology has progressed, the DC input voltage range requirements over which the inverter must operate have substantially increased to include lower and lower input voltages. One conventional solution for enabling the inverter to operate at lower input voltages and yet still supply the required high voltage AC is to increase the turns ratio of the transformer which is employed by the inverter to step up the AC voltage. Another approach is to retune the resonant tank circuit used by the inverter to accommodate the lower input voltages that are applied to the inverter. Unfortunately, these approaches result in decreased efficiency across the entire input voltage range.

What is needed is an IHS including a display which is powered in a manner wherein the inverter can operate across a wide input voltage range without substantial efficiency penalties.

SUMMARY

Accordingly, in one embodiment, a method is disclosed for operating an information handling system (IHS). The method includes converting a DC input voltage to an AC input voltage which is supplied to an AC transformer. The method also includes applying a first turns ratio of the AC transformer to the AC input voltage if the DC input voltage is within a first voltage range. The method further includes applying a second turns ratio of the AC transformer to the AC input voltage if the DC input voltage is within a second voltage range.

In another embodiment, an information handling system (IHS) is disclosed which includes an inverter circuit that is coupled to a load. In this particular embodiment the load is the backlight for a display. The inverter circuit is configured to convert a DC input voltage to an AC input voltage. The inverter circuit applies a first turns ratio of an AC transformer to the AC input voltage if the DC input voltage is within a first voltage range. Alternatively, the inverter applies a second turns ratio of an AC transformer to the AC input voltage if the DC input voltage is within a second voltage range. The load is coupled to an output of the AC transformer at which a stepped up AC output voltage is produced.

A principal advantage of one or more of the embodiments disclosed is the ability of the inverter of the IHS to operate over a wider input voltage range without a substantial decrease in efficiency.

DETAILED DESCRIPTION

Figure 1:
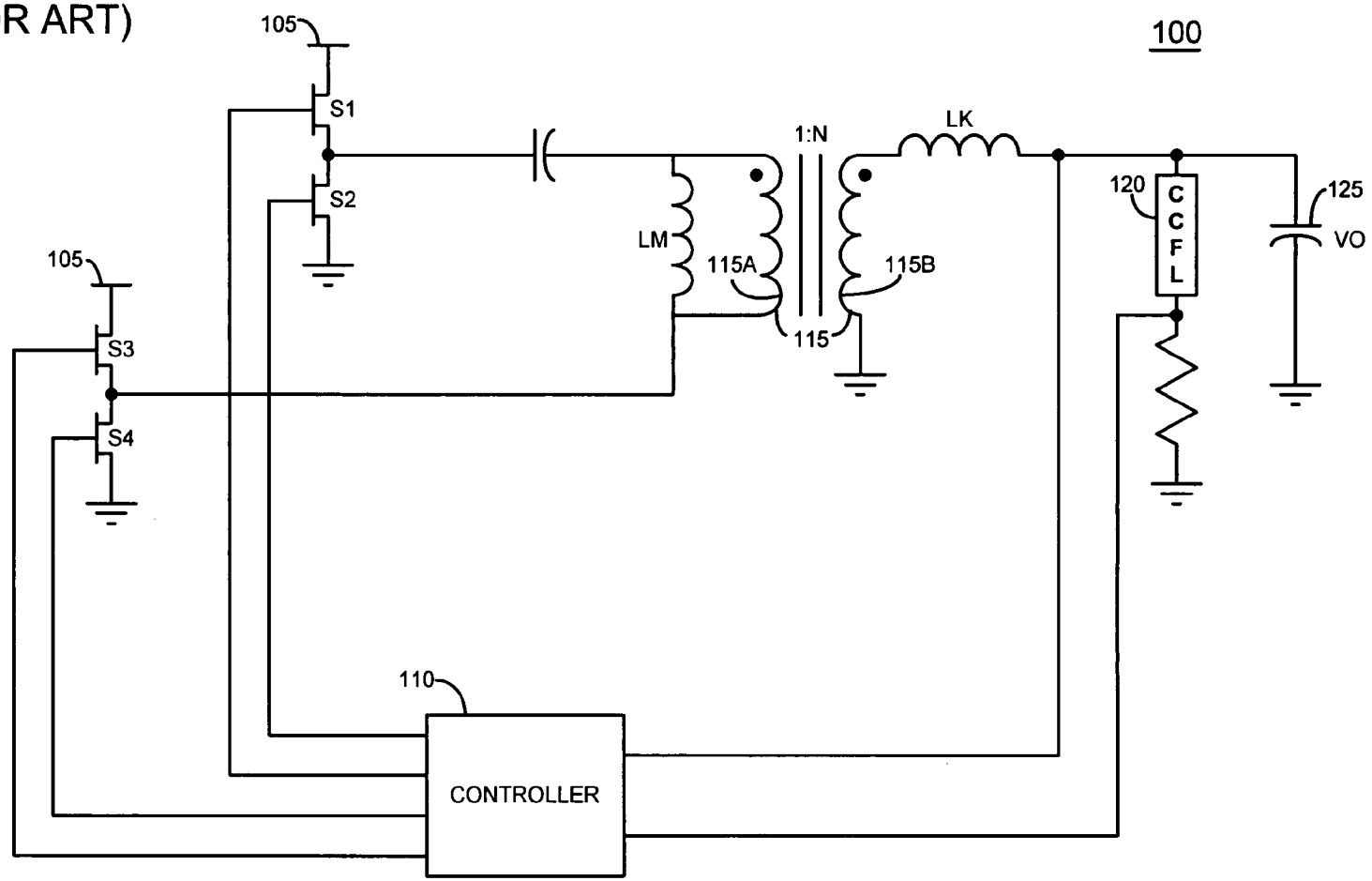
FIG. 1 (PRIOR ART)
FIG. 1 is a schematic diagram of a conventional inverter circuit

FIG. 1 is a schematic diagram of a conventional inverter circuit 100. A supply of DC power 105 is coupled to switching transistor pairs S1, S2 and S3, S4 which are arranged in a full bridge configuration as shown. Controller 110 includes-4 four output lines that are respectively coupled to the gate inputs of switching transistors S1, S2, S3 and S4 to control when these switching transistors are turned on and off. More specifically, controller 110 instructs switching transistors S1, S4 to turn on to send current through primary 115A of transformer 115 in a one direction and then instructs switching transistors S2, S3 to turn on to send current through primary 115A in the opposite direction. This sequence is continuously repeated so that the now alternating voltage in primary 115A induces a high voltage AC signal in secondary 115B. Transformer 115 exhibits a turns ratio, 1:N, that is selected such that the AC output voltage, VO, is sufficiently high to light cold cathode fluorescent light (CCFL) 120.

Transformer 115 includes a magnetizing inductance, LM, and a leakage inductance, LK, as shown in FIG. 1. A resonant tank circuit is formed by secondary 115B, leakage inductance, LK, and an output capacitor 125. Unfortunately, when the operating range of inverter circuit 100 is extended to lower or higher input voltages, efficiency drops. Some techniques that can be used to increase the output voltage are to: 1) increase the turns ratio, and 2) optimize the resonant tank circuit. Unfortunately, the resultant inverter operates with decreased efficiency across the entire input voltage range when these approaches are employed.

Figure 2:
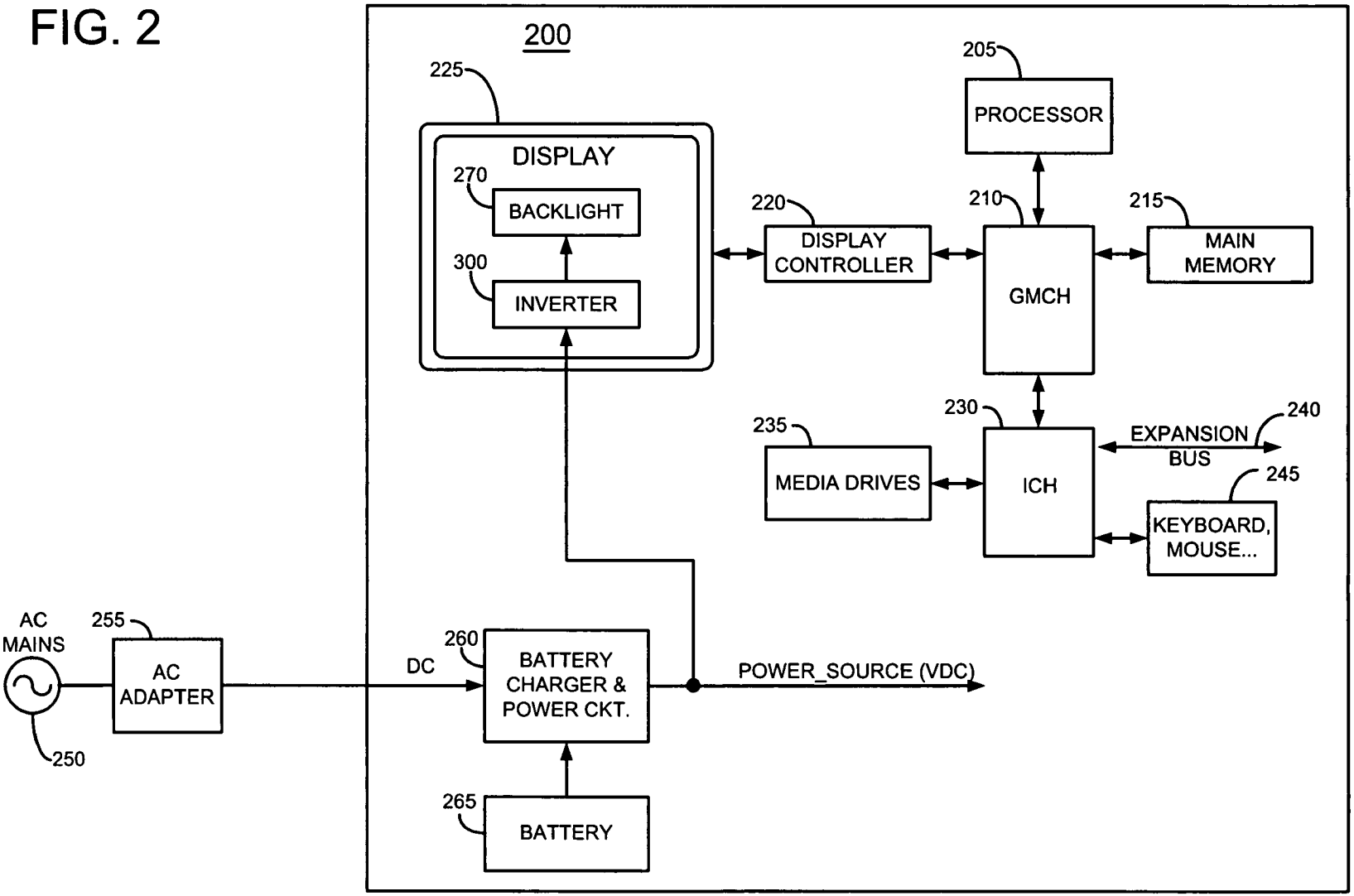
FIG. 2 is a block diagram of an embodiment of an information handling system which incorporates the disclosed inverter technology.

FIG. 2 is a block diagram of an information handling system (IHS) 200 in which the disclosed inverter technology is employed. For purposes of this disclosure, an information handling system (IHS) may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a video display, a keyboard, a mouse, voice inputs and other human interface devices (HIDs). The information handling system may also include one or more buses operable to transmit communications between the various hardware components.

As shown in FIG. 2, IHS 200 includes a processor 205 such as an Intel Pentium series processor, an Advanced Micro Devices (AMD) processor or one of many other processors currently available. A graphics/memory controller hub (GMCH) chip 210 is coupled to processor 205 to facilitate memory and display functions. System memory 215 and a display controller 220 are coupled to GMCH 210. A display 225 can be coupled to display controller 220 to provide visual images to the user. An I/O controller hub (ICH) chip 230 is coupled to GMCH chip 210 to facilitate input/output functions for the IHS. Media drives 235 are coupled to ICH chip 230 to provide permanent storage to the IHS. An expansion bus 240 is coupled to ICH chip 230 to provide the IHS with additional plug-in functionality. Expansion bus 240 may be a PCI bus, PCI Express bus, SATA bus, USB or virtually any other expansion bus. Input devices 245 such as a keyboard and mouse are coupled to ICH chip 230 to enable the user to interact with the IHS.

In this particular embodiment, IHS 200 is coupled to a source of AC power, namely AC mains 250. An AC adapter 255 is coupled between AC mains 250 and a battery charger/power circuit 260 to provide IHS 200 with a source of DC power to supplement DC power provided by battery 265.

Display 225 includes an inverter 300 which is coupled to a backlight 270. Inverter 300 takes relatively low voltage DC and converts it to relatively high voltage AC which has sufficient amplitude to light backlight 270. Backlight 270 is typically a cold cathode fluorescent light (CCFL) light. In this particular embodiment, inverter 300 is capable of operating in an input voltage range of approximately 6.5 to approximately 21 volts DC and generating an output voltage of approximately 1000 volts AC.

Figure 3:
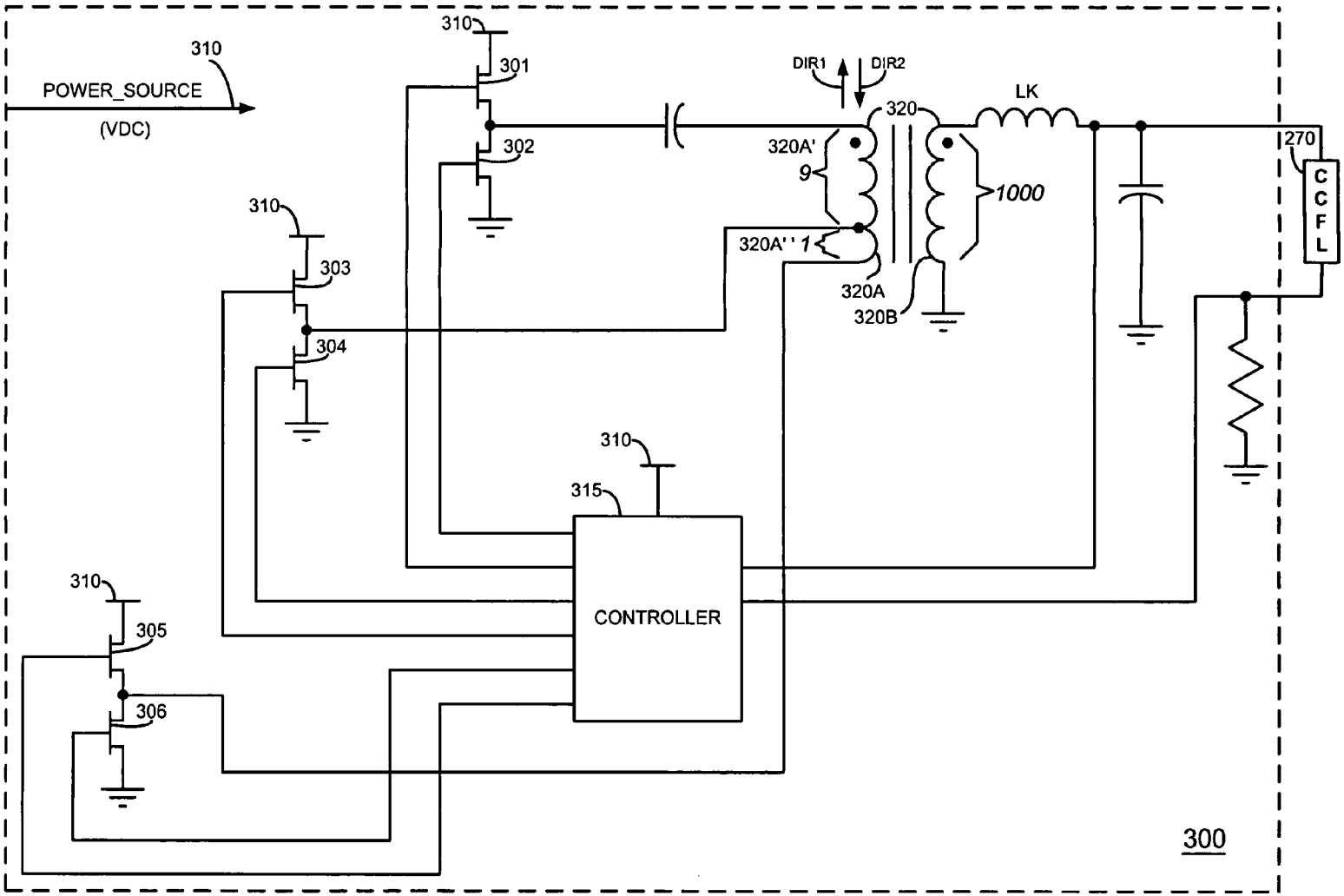
FIG. 3 is a schematic diagram of the disclosed inverter circuit which is used in the IHS of FIG. 2.

FIG. 3 is a schematic diagram of inverter 300. The input voltage provided to inverter 300 is designated as the POWER_SOURCE (VDC) signal which is also labeled as power source 310. Power source 310 is indicated at multiple locations in inverter 300 that are supplied with the POWER_SOURCE input voltage. Inverter 300 includes switching transistor pair 301, 302, switching transistor pair 303, 304 and switching transistor pair 305, 306 connected to a controller 315 and to the primary 320A of transformer 320 as shown. Controller 320 sends control signals to particular switching transistors 301, 302 . . . 306 to instruct those transistors when to turn on and when to turn off. When inverter 300 is supplied an input voltage at 310 that is between 10 and 21 volts, then inverter 300 operates in a "normal mode". However, when the input voltage decreases to less than 10 volts, then inverter 300 switches to a "boost mode" during which a larger turns ratio is applied to the AC voltage in primary 320A of transformer 320 than is applied in the normal mode.

It is noted that transformer 320 includes a split primary 320A having a section 320A' and another section 320A". The designator "9" at section 320A' and the designator "1" at section 320A" indicate the relative number of turns in the turns ratio of these sections with respect to the number of turns in secondary 320B, namely "1000" in this particular example. As explained in more detail below, when the inverter is operating in normal mode, it will be operating across the full primary coil, namely across both sections 320A' and 320A", for a total of 10 turns relative to the 1000 turns of the secondary. The turns ratio is thus 1000/10 in this particular example for normal mode. However, when the input voltage to the inverter drops below the 10 volt threshold, the boost mode is engaged wherein the larger turns ratio afforded by the primary section 320A' alone is employed. The turns ratio is then 1000/9 in this particular example for boost mode. It is noted that primary sections 320A' and 320A" be formed by two primary windings each with an end connected in common, or alternatively primary sections 320A' and 320A" be formed by a single primary winding which is tapped to form two sections.

Reference is made to TABLE 1 below for a more detailed presentation of the switching on-off states of switching transistors 301, 302 . . . 306 in the normal mode and boost mode.

TABLE 1

| | Normal Mode | Boost Mode |
|---|---|---|
| Input Voltage | 10 to 21 VDC | 6.5 to <10 VDC |
| Portion of Coil Used | Full Primary | Section of Primary |
| Turns Ratio (TR) | 1000/10 | 1000/9 (increased TR) |
| Primary current direction DIR1 | transistors 301, 306 ON | transistors 301, 304 ON |
| Primary current direction DIR2 | transistors 305, 302 ON | transistor 303, 302 ON |

To generate a high voltage AC signal in the secondary 320B of transformer 320, the DC input voltage is processed by switching transistors 301, 302, . . . 306 so that it alternatingly flows through the primary or a section thereof in direction DIR1 and then in direction DIR2. This alternating current which is now present in the primary induces a high voltage AC signal in secondary 320B. It is noted that the voltage and current are not necessarily in phase.

The normal mode of operation wherein the input voltage, POWER_SOURCE, provided to inverter 300 is within the range of 10–21 VDC, is discussed first. Controller 315 monitors the input voltage, POWER_SOURCE, to determine when the input voltage is within the 10–21 VDC range. If the input voltage is within that range, then normal mode operation commences. In normal mode, the full primary is used. Thus, a turns ratio of 1000/10 is applied. To implement normal mode, controller 310 sends control signals to transistors 301, 306 to turn those transistors on while the remaining transistors are turned off. With transistors 301, 306 thus closed, a current flows through the full primary of transformer 320 in the direction, DIR1. Once this has occurred, controller 315 turns transistors 305, 302 on while the remaining transistors are turned off. With transistors 305, 302 thus closed, a current now flows through the full primary in the opposite direction, namely DIR2. This sequence of current reversals and corresponding voltage reversals in the transformer primary is repeated under the direction of controller 310 to generate a pulsating AC signal in the transformer primary. This AC signal in the primary induces a corresponding high voltage AC signal in the secondary of the transformer. This high voltage AC signal is the result of applying the turns ratio of the full primary, namely 1000/10 to the AC signal on the primary.

To determine when "boost mode" should be commenced, controller 315 continually tests the POWER_SOURCE DC input voltage to determine if that voltage falls below 10 volts, or in this particular example, falls within the range of 6.5 to less than 10 volts. This range corresponds to the latter portion of the battery discharge cycle. If the DC input voltage falls within this range, then inverter 300 enters boost mode. The rightmost column of Table 1 details the switching states that switching transistors 301, 302, . . . 306 must assume for inverter 300 to enter boost mode.

In boost mode, a section of the primary less than the full primary winding is used. Thus, the turns ratio is effectively increased in boost mode as compared with normal mode. This turn ratio increase results in a corresponding increase in the AC output voltage of the inverter as compared to what the AC output voltage in this low input voltage range would be without boost mode. In this embodiment, primary section 320A' is used. Thus, an increased turns ratio of 1000/9 is applied. Referring again to the rightmost column of Table 1, to implement boost mode, controller 315 sends control signals to transistors 301, 304 to turn those transistors on while the remaining transistors are turned off. With transistors 301, 304 thus closed, a current flows through the primary section 320A' in the direction, DIR1. Once this has occurred, controller 315 turns transistors 303, 302 on while the remaining transistors are turned off. With transistors 305, 302 thus closed, a current now flows through the primary section 320A' in the opposite direction, namely DIR2. This sequence is repeated under the direction of controller 315 to generate a pulsating AC signal in the primary of transformer 320. This AC input signal in the primary induces a corresponding high voltage AC signal in the secondary of the transformer. This high voltage AC output signal is the result of applying the increased turns ratio of the primary section 320A', namely 1000/9 to the AC signal on the primary side.

While in the particular embodiment disclosed, the normal mode operates in the range of 10 to 21 VDC and the boost mode operates in the range of less than 10 volts down to 6.5. These values are given as examples and should not be taking as limiting. Depending on the particular application, these ranges can be shifted up or down to meet the needs of that application. Moreover these ranges can be made wider or narrower as desired for the particular application.

The disclosed methodology and apparatus provide the power inverter of an information handling system with a wider input voltage operating range while simultaneously providing better efficiency in that range.

It is noted that when one component is coupled to another, it is possible that the coupling may occur through one or more intermediate circuits or devices. Although illustrative embodiments have been shown and described, a wide range of modification, change and substitution is contemplated in the foregoing disclosure and in some instances, some features of an embodiment may be employed without a corresponding use of other features. Accordingly, it is appropriate that the appended claims be construed broadly and in manner consistent with the scope of the embodiments disclosed herein.

What is claimed is:

1. A method of operating the information handling system (IHS) comprising:

converting a DC input voltage to an AC input voltage;

applying a first turns ratio of an AC transformer to the AC input voltage if the DC input voltage is within a first voltage range; and applying a second turns ratio of an AC transformer to the AC input voltage if the DC input voltage is within a second voltage range.

2. The method of claim 1 wherein the first voltage range is greater than the second voltage range.

3. The method of claim 2 wherein the second turns ratio is greater than the first turns ratio.

4. The method of claim 1 wherein the first turns ratio is associated with a full primary winding.

5. The method of claim 4 wherein the second turns ratio is associated with a section of the full primary winding.

6. The method of claim 1 wherein applying a first turns ratio includes determining if the DC input voltage is within the first voltage range.

7. The method of claim 6 wherein applying a second turns ratio includes including determining if the DC input voltage is within the second voltage range.

8. The method of claim 1 including generating a stepped up AC output voltage at an output of the AC transformer.

9. A method of operating an information handling system (IHS) comprising:

determining if a DC input voltage is within a first voltage range that is greater than a second voltage range;

converting the DC input voltage to an AC input voltage by alternatingly switching the DC input voltage in first and second directions through a primary winding of an AC transformer;

applying a first turns ratio to the AC input voltage when the DC voltage is in the first voltage range to generate an AC output voltage; and applying a second turns ratio to the AC input voltage when the DC voltage is in the second voltage range to generate the AC output voltage.

10. The method of claim 9 wherein the first turns ratio is associated with a full primary winding.

11. The method of claim 10 wherein the second turns ratio is applied by alternatingly switching the AC input voltage through a first section of the full primary winding.

12. The method of claim 9 wherein the primary winding includes a first section and a second section that are tightly coupled.

13. The method of claim 9 wherein the second turns ratio is greater than the first turns ratio.

14. The method of claim 13 wherein the second turns ratio is associated with a section of a full primary winding.

15. The method of claim 9 wherein applying a first turns ratio includes determining if the DC input voltage is within the first voltage range.

16. The method of claim 9 wherein applying a second turns ratio includes determining if the DC input voltage is within the second voltage range.

17. The method of claim 9 wherein the AC transformer action generates a stepped up AC output voltage.

18. An information handling system (IHS) comprising:

a load;

an inverter circuit that is configured to:

convert a DC input voltage to an AC input voltage;

apply a first turns ratio of an AC transformer to the AC input voltage if the DC input voltage is within a first voltage range; and apply a second turns ratio of the AC transformer to the AC input voltage if the DC input voltage is within a second voltage range;

wherein the load is coupled to an output of the AC transformer at which a stepped up AC output voltage is produced.

19. The IHS of claim 18 wherein the load is a display.

20. The IHS of claim 18 wherein the load is a CCFL backlight of a display.

21. The IHS of claim 18 wherein the first voltage range is greater than the second voltage range.

22. The IHS of claim 21 wherein the second turns ratio is greater than the first turns ratio.

23. The IHS of claim 18 wherein the first turns ratio is associated with a full primary winding.

24. The IHS of claim 23 wherein the second turns ratio is associated with a section of the full primary winding.

25. The IHS of claim 18 wherein the AC transformer includes an output at which a stepped up AC output voltage is generated.

26. A system comprising:

loading means inverting circuit means that is configured to:

convert a DC input voltage to an AC input voltage;

apply a first turns ratio of an AC transformer to the AC input voltage if the DC input voltage is within a first voltage range; and apply a second turns ratio of the AC transformer to the AC input voltage if the DC input voltage is within a second voltage range;

wherein the loading means is coupled to an output of the AC transformer at which a stepped up AC output voltage is produced.

* * * * *

UNITED STATES PATENT AND TRADEMARK OFFICE

CERTIFICATE OF CORRECTION

PATENT NO. : 7,012,380 B2
APPLICATION NO. : 10/875354
DATED : March 14, 2006
INVENTOR(S) : Erin L. Price et al.

It is certified that error appears in the above-identified patent and that said Letters Patent is hereby corrected as shown below:

Claim 1, Column 5, Line 62, delete “the” and insert --an--.

Claim 1, Column 5, Line 65, delete “an” and insert --the--.

Claim 7, Column 6, Line 16, delete “including”.

Signed and Sealed this

Tenth Day of July, 2007

JON W. DUDAS
*Director of the United States Patent and Trademark Office*